United States Patent [19]

Neininger

[11] Patent Number: 4,745,590

[45] Date of Patent: May 17, 1988

[54] ANNIVERSARY CLOCK WITH GLASS CASE

[75] Inventor: Günter Neininger, Villingen-Schwenningen, Fed. Rep. of Germany

[73] Assignee: Kieninger & Obergfell GmbH & Co., St. Georgen, Fed. Rep. of Germany

[21] Appl. No.: 870,169

[22] Filed: Jun. 3, 1986

[30] Foreign Application Priority Data

Apr. 16, 1986 [DE] Fed. Rep. of Germany ... 8610394[U]

[51] Int. Cl.[4] ..... G04B 17/02

[52] U.S. Cl. ..... 368/180; 368/179; 368/165

[58] Field of Search ..... 368/120, 180, 179, 165, 368/296

[56] References Cited

U.S. PATENT DOCUMENTS 2,625,787 1/1953 Reiner ..... 368/120

*Primary Examiner*—Bernard Roskoski

*Attorney, Agent, or Firm*—Karl F. Ross; Herbert Dubno

[57] ABSTRACT

A prismatic glass or transparent synthetic resin case for a clockwork on a base of an anniversary clock is provided on at least some of its planar facets with a decor whose resistance to peeling is ensured by the planarity of the facets to which the decor is applied. All surfaces of the case are planar and adjoin other surface elements at obtuse angles.

5 Claims, 1 Drawing Sheet

ANNIVERSARY CLOCK WITH GLASS CASE

FIELD OF THE INVENTION

My present invention relates to a clock which comprises a base, a clockwork on the base, and a case for the clockwork. More particularly, the invention relates to an anniversary clock having a glass case through which the clock is visible and which is provided with a decor.

BACKGROUND OF THE INVENTION

The anniversary clock generally comprises a base upon which a case having at least one transparent surface, is mounted, the clockwork being received in and protected by the case, generally having a torsion pendulum and being provided with a clock face which is juxtaposed with the transparent wall of the case.

Such clock cases have been provided in a variety of forms. In one form the case has a framework with glass panels, the framework being a comparatively massive structure which, while offering some aesthetic features which may be desirable in some cases, may be considered disadvantageous in others. An alternate construction of a clock case for an anniversary clock is a domed glass structure through which the clock within the case can be viewed at any angle. Such a clock case may have a cylindrical wall which merges into the dome. All-transparent clock cases of the latter type are frequently more aesthetic and desirable because they allow the interior form of the interior clockwork to contribute more fully to the aesthetic appearance of the clock as a whole.

However, difficulties have been encountered when efforts to apply a decor to the glass cases of the latter type is undertaken.

These difficulties were most pronounced when the decor was to be applied in the form of decalcomania or decorative foils which had a certain degree of stiffness and were compelled to adhere to the curved surfaces of the case. However, the difficulties were also pronounced when screen printing or other decorative techniques were applied for decorative purposes on the dome or curved surfaces.

Another disadvantage of the domed cylindrical cases was the spatial requirements of the clock since the domed cylindrical case precluded a relatively flat configuration of limited depth.

While the latter problem does not characterize the prismatic shapes obtained when the casing was provided with a frame receiving glass panels, in general such framed structures were not only relatively expensive and time consuming to fabricate, but the casing, because of the relatively massive frame structure, contributed significantly to the weight of the clock.

Furthermore, the metal or other parts of the frame work and the supports for the glass panels in such cases require fabrication by copying milling machines and other expensive tools, decoration apart from the glass panels, which involves still additional expense and, in general, unduly complicates the fabrication process.

OBJECTS OF THE INVENTION

It is, therefore, the principal object of the present invention to provide an improved clock, especially a table clock such as an anniversary clock, so as to simplify the fabrication thereof, reduce the cost, and especially overcome the drawbacks of earlier anniversary clock constructions.

Another object of the invention is is to provide an improved anniversary clock in which the application of decor is simplified and, particularly, foil or like decors can be applied without the degree of peeling.

SUMMARY OF THE INVENTION

These objects and others which will become more apparent herein are attained in accordance with the present invention by providing a table clock which comprises a base adapted to rest upon a table top, a glass case surmounting this base and a clockwork mounted on the base and received within the case and visible at all angles through the case.

According to the invention, the glass case is generally prismatic and is made of angularly adjoining flat elements, preferably being of integrated or one-piece construction.

More specifically, the fully transparent upright glass case of the invention is mounted on the base and encloses the clockwork, the case being prismatic and defined by a front wall juxtaposed with the clock face of the clockwork, a rear wall parallel to the front wall, a pair of mutually parallel side walls interconnecting the front and rear walls, and an upwardly convexed top formed by a plurality of angularly adjoining walls connected to the front, rear and side walls, all of the walls being planar and transparent. A foil decor is applied to at least some of these walls, and especially to at least some of the walls of the upwardly convexed top so the planarity of the wall to which the decor is applied, precluding peeling of the decor.

Not only does the glass case of the invention impart a unique aesthetic appearance to the clock, but since it is constructed only of flat elements whose edges angularly adjoin the edges of neighboring flat transparent elements, preferably at angles other than 90°, a unique refraction of light can occur in the case to impart lighting aesthetics to the overall appearance.

Not only is the application of decor simplified, since the decor itself can use inexpensive foils which can simply be applied by adhesive and even required foils with no flexibility or other decorative elements, but after the foils are applied, there is no tendency for them to peel from the surfaces.

According to a feature of the invention, an outer face of each of the walls forms a planar facet molding an obtuse angle with each adjoining one of these facets. The facets may include bevelled flat elements between the edges of the front rear and side walls and between the front and rear walls and the walls forming the convex top. The front and rear walls can be vertically elongated and have greater areas than any other walls and the bevels can be formed by trapezoidal flat wall elements. In a preferred case, the walls and elements total 17 in number and are all unitary or in one piece with one another.

BRIEF DESCRIPTION OF THE DRAWING

The above and other objects, features and advantages of the invention will become more readily apparent from the following description, reference being made to the accompanying drawing in which.

SPECIFIC DESCRIPTION

Figure 1:
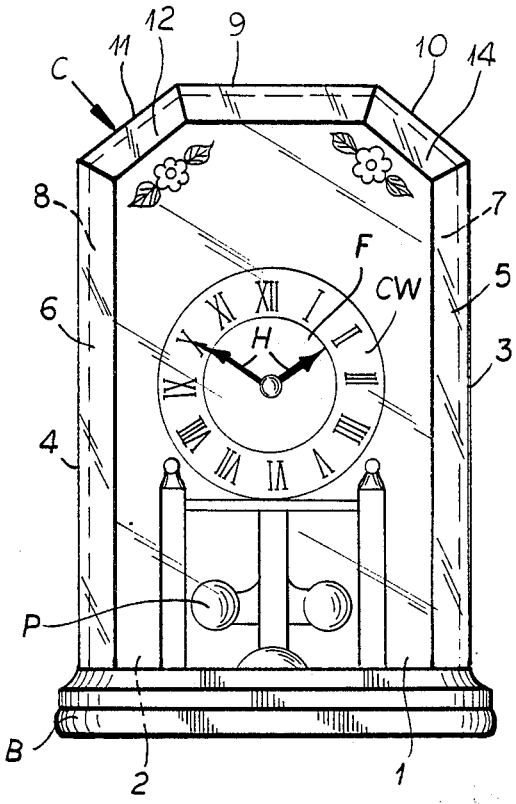
FIG. 1 is a vertical-elevational view of an anniversary clock according to the invention.

The anniversary clock shown in the drawing comprises a glass case or a transparent case made out of a synthetic resin material which is as transparent as glass and made in one piece so as to have only planar surfaces which adjoin one another at an angle other than 90°.

Figure 2:
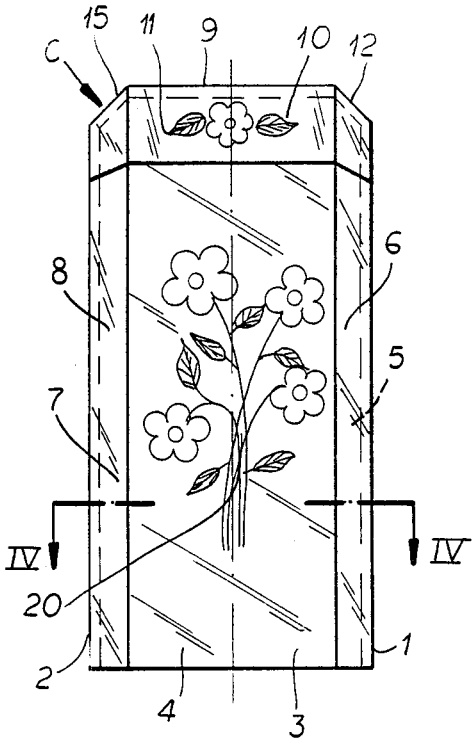
FIG. 2 is a side-elevational view of the one-piece glass case thereof.
Figure 3:
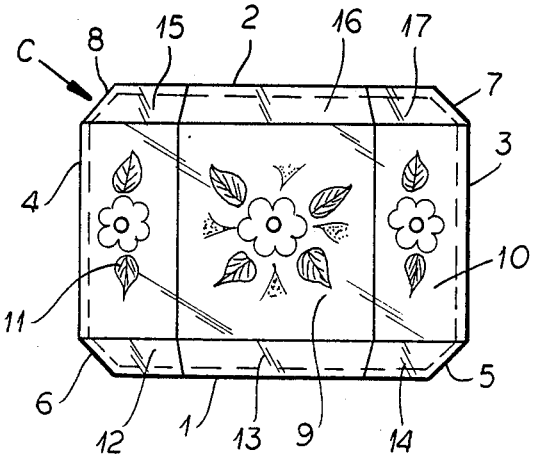
FIG. 3 is a top-plan view of this case.
Figure 4:
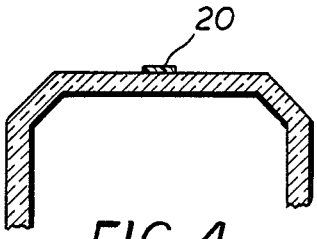
FIG. 4 is a diagrammatic section taken along the line IV—IV of FIG. 2.

The clock comprises a base B which can be of wood or some other material, a clockwork CW which can have a torsion pendulum P and a face F with hands H juxtaposed with the front side of the case C which has been shown in greater detail in FIGS. 2–4.

The case is vertically elongated and comprises a front wall 1 through which the clock face F is visible, a rear wall 2 parallel to the front wall and substantially coextensive therewith, the front and rear walls having the largest areas of the walls of the case.

A pair of mutually parallel side walls 3 and 4 are connected to the front and rear walls by bevelled planar wall elements 5, 6, 7 and 8, and a convex top is provided above the front, rear and side walls and is defined by a horizontal upper wall 9 and a pair of inclined walls 10 and 11 connecting the upper wall 9 with the side walls 3 and 4 so that the faces or facets of the adjoining walls 3, 10, the adjoining walls 9, 10, the adjoining walls 4, 11 and the adjoining walls 9, 11 are at an obtuse angle with one another.

The upper wall 9 and each of the inclined walls 10 and 11 are also connected to the front and rear walls 1 and 2 by bevelled wall elements 12, 13, 14, 15, 16 and 17, thereby imparting a prismatic shape to all portions of the casing.

Not only is the casing easily manufactured by pressing or injection molding, but it can be assembled from trapezoidal elements which are adhesively bonded at adjoining flanks. The polygonal structure easily receives a foil decor 20 which can provide a floral pattern as shown, without any tendency to peel because of a curvature of the surfaces of the case. Naturally, printing on the flat surfaces of other decorative patterns is also possible.

I claim:

1. A clock comprising:

a base;

a clockwork on said base having a clock face; and a fully transparent upright clock case mounted on said base and enclosing said clockwork, said case being prismatic and defined by a front wall juxtaposed with said clock face, a rear wall parallel to said front wall, a pair of mutually parallel side walls interconnecting said front and rear walls, and an upwardly convex top formed from a plurality of angularly adjoining walls connected to said front, rear and side walls, all of said walls being planar and transparent, an outer face of each of said walls forming a planar facet including an obtuse angle with each adjoining one of said facets and, said top comprising a horizontal upper wall and a pair of inclined walls adjoining said upper wall and respectively extending downwardly therefrom to each of said side wall, said upper wall and said inclined walls forming angularly adjoining facets including obtuse angles between them, edges between said front wall and said side walls, edges between said rear wall and said side walls, edges between said front, rear and side walls and said top and inclined walls all being respectively beveled with planar bevels providing additional ones of said facets, said front and rear walls being vertically elongated and have greater areas than any other of said walls, the bevels at said edges being formed by trapezoidal flat wall elements.

2. A clock as defined in claim 1, further comprising a decor on at least some of said facets.

3. The clock defined in claim 1 wherein an outer face of each of said walls forms a planar facet including an obtuse angle with each adjoining one of said facets and said decor is a foil adherent to said some of said walls.

4. The clock defined in claim 1 wherein said elements and said wall total seventeen in number.

5. The clock defined in claim 1 wherein said case and all of said walls and said elements are formed in a single piece.

* * * * *